US006225567B1

(12) United States Patent
Kester

(10) Patent No.: US 6,225,567 B1
(45) Date of Patent: May 1, 2001

(54) POLYMERIC WEATHERSHED SURGE ARRESTER AND METHOD

(75) Inventor: Jeffrey Joseph Kester, Richfield, OH (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 09/142,076

(22) PCT Filed: Feb. 26, 1997

(86) PCT No.: PCT/US97/02967

§ 371 Date: Apr. 27, 1999

§ 102(e) Date: Apr. 27, 1999

(87) PCT Pub. No.: WO97/32317

PCT Pub. Date: Sep. 4, 1997

Related U.S. Application Data

(60) Provisional application No. 60/012,637, filed on Mar. 1, 1996.

(51) Int. Cl.[7] ..... H01B 17/12

(52) U.S. Cl. ..... 174/178; 174/209

(58) Field of Search ..... 174/209, 211, 174/212, 174, 176, 177, 178, 189, 137 R, 138 R, 139, DIG. 10

(56) References Cited

U.S. PATENT DOCUMENTS

| | | | | |
|---|---|---|---|---|
| 4,028,656 | * | 6/1977 | Schmunk et al. | 337/186 |
| 4,045,604 | * | 8/1977 | Clabburn | 428/36 |
| 4,885,039 | * | 12/1989 | Thevenet | 156/294 |
| 5,214,249 | * | 5/1993 | Goch et al. | 174/179 |
| 5,220,134 | * | 6/1993 | Novel et al. | 174/179 |
| 5,633,478 | * | 5/1997 | Ishino | 174/179 |

FOREIGN PATENT DOCUMENTS

2229330 A * 9/1990 (GB) .

* cited by examiner

*Primary Examiner*—Kristine Kincaid
*Assistant Examiner*—Charlie Nguyen
(74) *Attorney, Agent, or Firm*—Fish & Richardson P.C.

(57) ABSTRACT

An elastomeric surge arrester housing includes a sleeve having a tubular core and radiating sheds. The sleeve is molded in a first configuration and, when the core is radially stretched, assumes a second configuration in which the sheds assume a downwardly extending configuration. The sheds, in the second configuration, include an upper surface having a generally frustoconical shape. The housing may be made using conventional molding techniques, but requires substantially less material than if the housing were molded directly into the second configuration.

29 Claims, 3 Drawing Sheets

POLYMERIC WEATHERSHED SURGE ARRESTER AND METHOD

This application claims the benefit of the U.S. Provisional No. 60/012,637 filed Mar. 1, 1996.

BACKGROUND OF THE INVENTION

The present invention relates generally to electrical power distribution equipment. More particularly, the invention relates to surge arresters. Still more particularly, the invention relates to surge arresters employing polymeric weathersheds.

Under normal operating conditions, electrical transmission and distribution equipment is subject to voltages within a relatively narrow range. Due to lightning strikes, switching surges or other system disturbances, portions of the electrical network may experience momentary or transient voltage levels that greatly exceed the levels experienced by the equipment during normal operating conditions. Left unprotected, critical and costly equipment such as transformers, switching apparatus, computer equipment, and electrical machinery may be damaged or destroyed by such over-voltages and the resultant current surges. Accordingly, it is routine practice to protect such apparatus from dangerous over-voltages through the use of surge arresters.

A surge arrester is a protective device that is commonly connected in parallel with a comparatively expensive piece of electrical equipment so as to shunt or divert the over-voltage-induced current surges safely around the equipment, thereby protecting the equipment and its internal circuitry from damage. When caused to operate, a surge arrester forms a current path to ground having a very low impedance relative to the impedance of the equipment that it is protecting. In this way, current surges which would otherwise be conducted through the equipment are instead diverted through the arrester to ground.

Conventional surge arresters typically include an elongate outer housing made of an electrically insulating material, a pair of electrical terminals at opposite ends of the housing for connecting the arrester between a line-potential conductor and ground, and an array of electrical components in the housing that form a series path between the terminals. These components typically include a stack of voltage dependent, nonlinear resistive elements. These nonlinear resistors or "varistors" are characterized by having a relatively high resistance at the normal steady-state voltage and a much lower resistance when the arrester is subjected to transient over-voltages. Depending on the type of arrester, it may also include one or more electrodes, heat sinks or spark gap assemblies housed within the insulative housing and electrically in series with the varistors.

To ensure proper operation of the arrester, the varistors and other internal components must be isolated from moisture and environmental pollutants. The arrester housing serves to seal the components from the ambient environment. Additionally, most surge arrester housings include "skirts" or "weathersheds" spaced apart along the length of the housing. An arrester, once installed outdoors, will be exposed to contaminants or environmental pollutants that are deposited on the housing surface by rain, wind and other conditions. These contaminants, over time, may build up to such a degree that they form a path for current. Such buildup effectively reduces the distance between energized or line-potential components and ground. In this manner, the surface resistivity of the arrester housing will decrease to a point where flashover may occur and a short circuit result.

Accordingly, weathersheds have traditionally been included on an arrester housing to extend or lengthen the housing surface and increase the effective distance between the energized arrester terminal and ground. Additionally, weathersheds have been designed to enhance the ability of the arrester to resist or to minimize the degree to which dust and environmental contaminants may build up on the housing's outer surface. Such designs have included varying the radii of adjacent sheds, using particularly designed materials that resist the effects of contamination, and by varying the number and size of the sheds on the housing.

Surge arrester housings made of porcelain were once the industry standard. Unfortunately, such arrester housings were fragile and frequently were the subject of vandalism. Additionally, the porcelain housing was heavy, requiring a substantial support means to mount the arrester. Furthermore, when a porcelain housed arrester failed, it was not uncommon for the housing to explode, sending porcelain fragments at high velocities in all directions. Such failures presented the obvious potential for danger to personnel and damage to equipment.

Presently, at least in distribution class surge arresters, a polymeric housing has become a standard feature. A polymeric housing is less expensive to manufacture, is nonfragmenting and is less susceptible to damage during shipment, installation and use compared to prior art porcelain housings. Additionally, a polymeric housing is substantially lighter, allowing simpler and less costly installation.

The polymeric arrester housing is typically molded of silicone rubber or another elastomeric material. The housing includes a central core and radiating sheds or skirts which are molded integrally with the central core. The central core includes an internal bore or chamber that is substantially the same diameter as the varistors and other arrester components to be housed therein. Where a particular shape or orientation of the sheds is desired, the mold for the housing is manufactured so as to provide that desired configuration.

Present molding techniques effectively limit the configuration and arrangement of sheds on a polymeric arrester housing. Further, because of limitations in the molding process, manufacturing housings with certain weathershed orientations is costly and difficult. Also, the present methods of obtaining a good bond between the inside surface of the housing and the internal components is expensive and generates a substantial amount of scrap material.

Accordingly, there remains a need in the art for a polymeric arrester housing having an enhanced weathershed design that will resist buildup of environmental pollutants and, at the same time, is relatively simple to manufacture using conventional molding techniques. It would further be advantageous if the housing provided a superior bond between the inside surface of the housing and the internal electrical components. Given the present cost of silicone rubber and other elastomeric materials known to be employed in arrester housings, it would be further advantageous if the weathershed could be manufactured using less material than presently employed for similar housings.

SUMMARY OF THE INVENTION

The present invention includes an elastomeric housing for a surge arrester that includes a deformable shedded sleeve with a tubular core having central bore and a plurality of axially-spaced sheds radially extending from the core. The sleeve has a first configuration when the core is unstretched, and a second configuration when the core is stretched. When the core is stretched radially, the sheds assume a new configuration in which the upper surface is generally frustoconical and in which the ends of the sheds move axially from their initial configuration; however, the ends of the sheds remain at the same predetermined radial position in both the first and second configuration. It is preferred that the sheds extend downwardly from the core at an angle within the range of approximately 10 to 60°, and more preferably 10 to 45°, when the sleeve is in the stretched configuration.

The elastomeric housing is preferably made of a silicon rubber and is molded in the first, unstretched configuration. In that configuration, the upper surface of the shed joins the core portion in a shoulder having a radius of curvature of $R_1$ and the lower surface of the shed joins the core portion in a lower shoulder having a radius of curvature $R_2$, $R_1$ being greater than $R_2$. Additionally, in the first configuration, the upper surface of the shed includes a first transition point where two frustoconical surface segments are joined. Also, in the first configuration, the lower surface of the shed includes a second transition point at the intersection of a pair of frustoconical surface segments. The frustoconical surface segments on the upper surface taper downwardly while the frustoconical surface segments on the lower surface taper upwardly. The sheds are configured such that the second transition point is closer to the axis of the housing than the first transition point. In addition, the downward angle on the top side is preferably greater than or equal to the upward angle on the bottom side.

The present invention permits an elastomeric arrester housing to be created with appropriately configured, downwardly extending sheds, but allows the housing to be molded with sheds that are substantially perpendicular to the axis of the housing. This provides significant manufacturing advantages in that it is a much simpler process to mold an elastomeric housing having sheds that extend substantially perpendicular to the housing axis. Additionally, the invention permits an elastomeric housing that may be stretched or deformed so as to have a particularly advantageous configuration of downwardly extending sheds where the housing is manufactured using significantly less volume of elastomeric material than if the housing were molded into the ultimately-desired configuration using conventional techniques. These and various other characteristics and advantages of the present invention will be readily apparent to those skilled in the art upon reading the following detailed description in referring to the accompanying drawings.

BRIEF DESCRIPTION OF THE DRAWINGS

For an introduction to the detailed description of the preferred embodiments of the invention, reference will now be made to the accompanying drawings, wherein.

DESCRIPTION OF PREFERRED EMBODIMENTS

Figure 1:
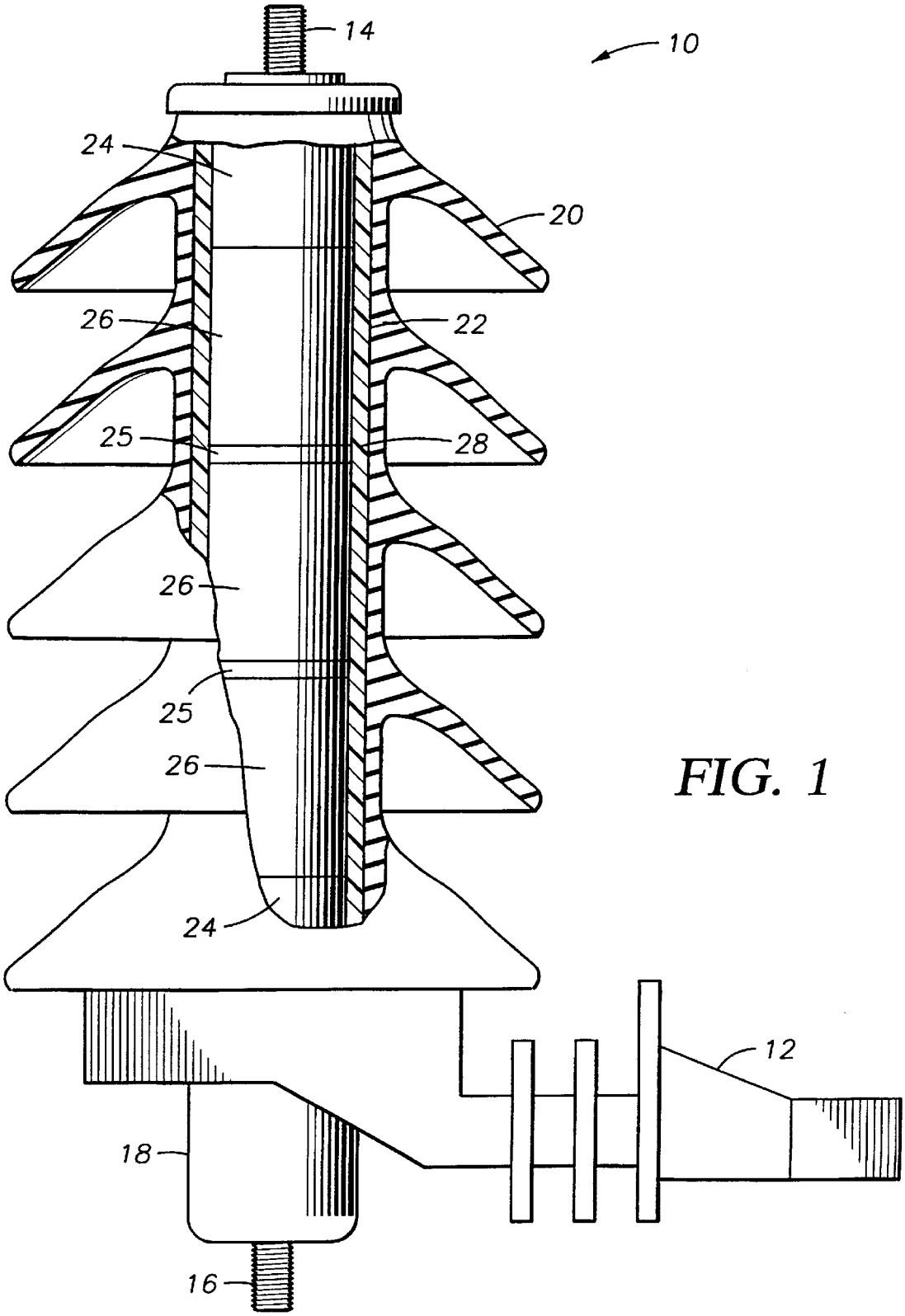
FIG. 1 is an elevational view, partially cutaway and partially in cross-section, showing the surge arrester and arrester housing of the present invention.

It will be understood that the following components are representative of the contexts in which the present invention can be used and are not intended to be an exhaustive identification thereof. Referring first to FIG. 1, surge arrester 10 and arrester housing 20 of the present invention are shown. Arrester 10 generally comprises hanger 12, top and bottom terminal studs 14, 16, ground lead disconnector 18 and elastomeric housing 20. Arrester 10 is supported by arrester hanger 12 which, in turn, is mounted to a utility pole or other support member (not shown). Housing 20 encloses an array 22 of arrester components which is an electrical device that are maintained in stacked end-to-end arrangement by an insulative component retention means 28. Retention means 28 may comprise, for example, an insulative liner such as that shown in U.S. Pat. No. 4,930,039 or filament windings such as disclosed in U.S. Pat. Nos. 5,138,517, 4,656,555 or 5,043,838. It is preferred, however, that insulative component retention means 28 be made in the form of a hardened resinous coating, reinforced with glass fibers, and having a coefficient of thermal expansion that is greater than the coefficient of thermal expansion of the electrical components in array 22 so as to provide an axial load on the components once cured and cooled. Such an embodiment is described in copending U.S. application entitled Self-Compressive Surge Arrester Module and Method of Making Same, Ser. No. 60/012,667, filed Mar. 1, 1996, the entire disclosure of which is incorporated herein by this reference.

Array 22 includes electrodes 25, metal oxide varistors (MOV's) 26 and end terminals 24 at each end. Upper and lower conducting studs 14, 16 threadedly engage central threaded bores (not shown) in the ends of terminals 24 so as to provide a means for connecting line potential and ground lead conductors (not shown) to arrester 10. Conventional ground lead disconnector or isolator 18 is disposed about terminal stud 16 to provide a means to explosively disconnect the ground lead in the event of arrester failure. MOV's 26 are stacked within array 20 in end-to-end relationship with electrodes 25 disposed between facing surfaces of adjacent MOV's 26. MOV's 26 may be in the form of any conventionally available metal oxide varistor. Although not shown in FIG. 1, array 22 may also include a variety of other electrical components, including heat sink or spacer elements or spark gap assemblies which may themselves include ceramic materials, such as silicon carbide rings having voltage dependent resistances.

Figure 2:
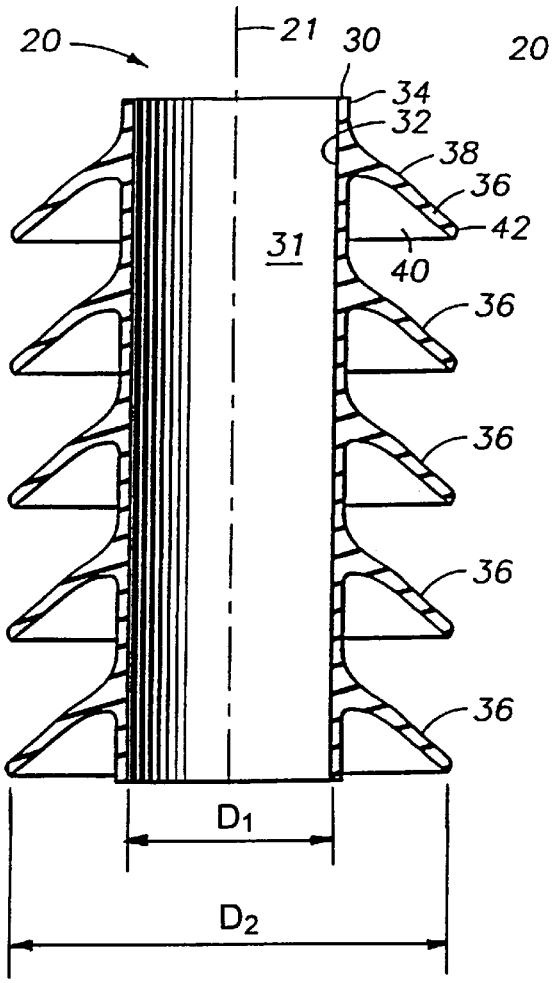
FIG. 2 is a cross-sectional view of the arrester housing shown in FIG. 1.

Housing 20 is best shown in FIG. 2. Housing 20, as shown, has particular utility when employed in a distribution class surge arrester. Although the principles of the present invention may be employed in surge arresters having other physical dimensions and ratings, the invention will be understood and will be described herein with reference to the 10 KA heavy duty 10 KV (8.4 KV MCOV) distribution class arrester shown in FIG. 1.

Referring still to FIG. 2, housing 20 generally comprises a sleeve having a central tubular core 30 and downwardly extending sheds 36 attached to core 30 in axially spaced apart relation. Housing 20 may therefore be described as a shedded sleeve. Core 30 includes central bore 31, inner cylindrical surface 32 and outer cylindrical surface 34. Sheds 36, which are integrally molded with core 30, extend from outer surface 34 and include an upper surface 38, lower surface 40 and outer edge 42. Upper and lower surfaces 38, 40 are generally frustoconical in shape although, as described more fully below with reference to FIG. 5, surfaces 38 and 40 each include certain segments 61, 63 that are concave and other segments 62 that are convex. Sheds 36 extend radially outward from core 30 and preferably are inclined between approximately 10 and 60°, and more preferably between 20 and 45°, from a plane perpendicular to the central axis of housing 20. This angle of inclination indicates the angle of the greater top shed surface 38.

The inclined shed shape has several advantages. The inclined angle assures that a portion of the shed is protected from both contamination and wetting such that it maintains a high surface resistivity. The remaining surface can become contaminated with salts and dust and will have a much lower surface resistivity when wet, but the inclination will tend to wash much of the contamination off.

Still referring to FIG. 2 in its as-used configuration, core 30 includes an inside diameter $D_1$ measured from opposite sides of inner cylindrical surface 32 and an overall outer diameter $D_2$ as measured from opposite shed ends 42 as shown in FIG. 2. In this embodiment, $D_1$ is substantially equal to 1.7 inches and $D_2$ substantially equal to 3.6 inches. Housing 20 is molded from an elastomeric material to enable the housing to be stretched as described more fully below. Preferably, housing 20 is made of polymeric material, such as silicone rubber. To permit the stretching and deformation required, housing 20 should be made from a silicone rubber. While other elastomeric compounds can be used, silicone is preferred because of its natural resistance to UV radiation. Although other compounds can be formulated to resist UV degradation, some surface damage will still occur, increasing the risk of tear propagation from surface flaw sites. The advantage of using silicone to form the housing lies in the ability of silicone to repel water. When water full of contaminants beads up on the surface, the surface resistivity is much higher than if the water were present as a surface wetting film. Other materials have provided a hydrophobic quality when new, but lose this trait as they age. Suitable materials for housing 20 are those supplied by Dow Corning STI, General Electric Silicones, Wacker Silicones, DuPont, and Uniroyal, and having elongation at break per ASTM D412 higher than the stretched elongation levels and also exhibiting good physical and electrical performance for their operating environment per well known industry standards. The preferred polymer system is a highly filled silicone system containing Aluminum Trihydrate ("ATH") surface treated fumed silica and optional extending fillers such as silica flour. This system preferably has an elongation at break of greater than 300%, a durometer (shore A) of less than 50, and a Wet Arc Track performance of 180 minutes at 6 kV when the sample is tested at stretched level approximately 125% of the level in the application. An additional desirable criteria is for the failure mode after Wet Arc Track Testing to be nontracking in nature, i.e., due to material erosion, and such that there is no evidence of tear propagation at the failure site. If these conditions are met, the housing will continue to withstand voltage and extend product life, even after a localized material failure has occurred.

Figure 3:
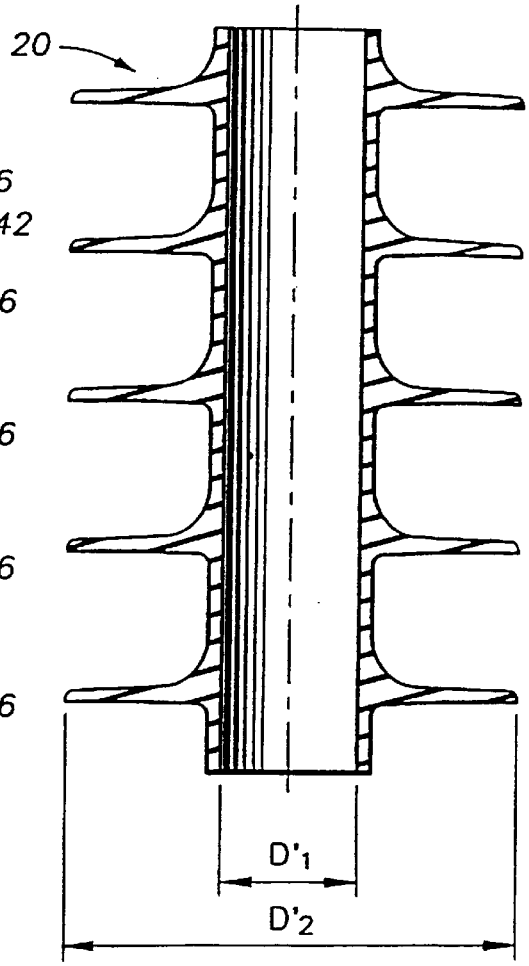
FIG. 3 is a cross-sectional view of the housing shown in FIG. 2 in its as-molded and unstretched configuration.

Referring now to FIG. 3, housing 20 is shown in its as-molded configuration, prior to it being stretched and deformed into its as-used configuration so as to accommodate MOV's 26 and the other arrester components of array 22 which is an electrical device. In this unstretched configuration, sheds 36 are axially spaced apart approximately 1.375 inches and core 30 has an inside diameter of $D_1'$ and an outside diameter $D_2'$. In its unstretched configuration, $D_1'$ is approximately 1.2 inches, or 60 to 90% of $D_1$. Importantly, however, the outside diameter $D_2'$ of the unstretched housing 20 is substantially the same as the overall diameter $D_2$ of housing 20 when stretched. To achieve the desired configuration of housing 20 as shown in FIG. 2 when inside diameter $D_1'$ is increased to $D_1$, it is important that housing 20 and, particularly, sheds 36 be molded to have particular inclinations and radii of curvature and degrees of taper. More specifically, and referring now to FIG. 4, upper surface 38 of shed 36 joins outer surface 34 of core 30 at upper arcuate surface 46. The terms "upper" and "lower" are used hereinafter to refer to relative positions and orientations as shown in the figures. Upper arcuate surface 46 (first shoulder) has a radius of curvature designated as L, $R_1$ which, in the embodiment shown is substantially equal to 0.375 inches. Similarly, lower surface 40 of shed 36 intersects core outer surface 34 at lower arcuate surface 48 (second shoulder), which has a radius of curvature equal to $R_2$. In this embodiment, $R_2$ is substantially equal to 0.093 inches. Without regard to the precise radii, to achieve the desired change in inclination and shape of weathersheds 36 from that shown in FIG. 1 to that shown in FIG. 2, $R_1$ should be greater than $R_2$ and is preferably at least twice as great as R. In addition, the downward angle on the top side is preferably greater than or equal to the upward angle on the bottom side.

Figure 4:
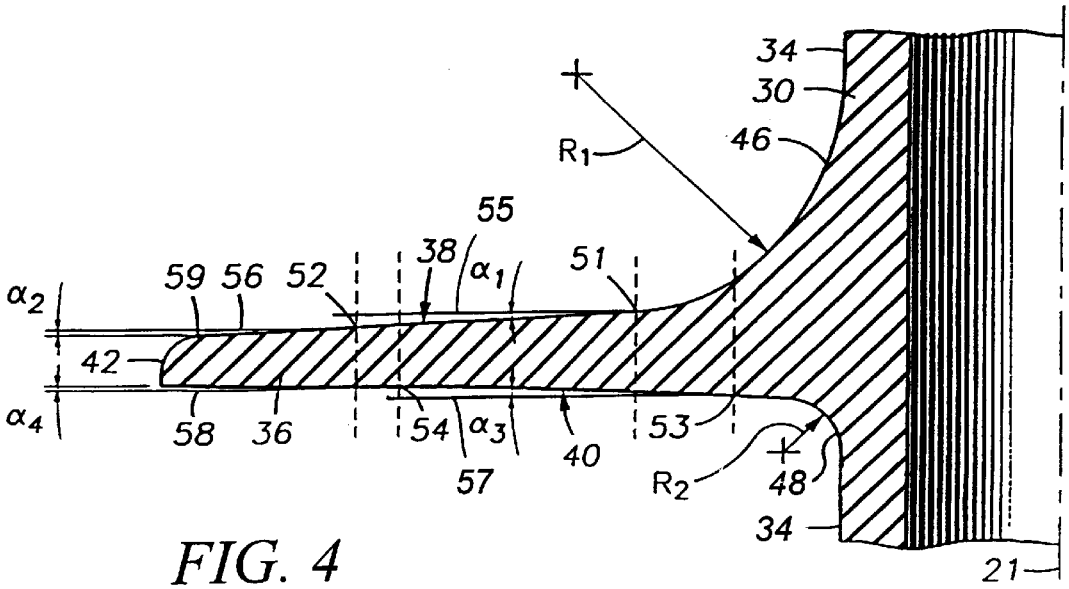
FIG. 4 is an enlarged view of a portion of the as-molded and unstretched housing shown in FIG. 3.

Referring still to FIG. 4, upper and lower surfaces 38, 40 each include a pair of frustoconical segments having varying degrees of incline or decline as measured from a plane that is substantially perpendicular to the longitudinal axis of housing 20. These frustoconical segments are best described with reference to transition points 51–54. As molded, shed 36 includes an upper surface comprising first and second upper frustoconical segments 55, 56 and a lower surface 40 comprising first and second lower frustoconical segments 57, 58. First upper frustoconical surface segment 55 extends between transition point 51 and transition point 52 and slopes downwardly at an incline from horizontal equal to $\alpha_1$. Second upper frustoconical surface segment 56 extends from transition point 52 to shoulder 59 adjacent outer edge 42, and tapers downwardly at an angle from horizontal equal to $\alpha_2$. First lower frustoconical surface segment 57 extends between transition points 53 and 54 and inclines upwardly from the horizontal at an angle equal to $\alpha_3$. Second lower frustoconical surface segment 58 extends between transition point 54 and outer edge 42 and is inclined upward from the horizontal at an angle equal to $\alpha_4$. $\alpha_1$–$\alpha_4$ will vary depending upon the size of housing 20 and the precise operational orientation desired of sheds 36, however, for the embodiment shown in FIG. 1, for example, $\alpha_1$–$\alpha_4$ will have the following values.

| Angle | Degrees |
|---|---|
| $\alpha_1$ | 10° |
| $\alpha_2$ | 1° |
| $\alpha_3$ | 0.5° |
| $\alpha_4$ | 0.5° |

Without regard to the precise values of $\alpha_1$–$\alpha_4$, according to the invention, transition point 51 should be at a greater radius from the axis 21 of housing 20 than transition point 53, and transition point 52 should be at a greater radius than transition point 54. In the specific embodiment described herein, transition point 52 is located at a radial distance substantially equal to 1.467 inches, while transition point 54 is located at a radial distance substantially equal to 1.342 inches. Also in this embodiment, transition point 51 is located at a radial distance substantially equal to 0.37 inches and transition point 53 is located at a radial distance substantially equal to 0.09 inches.

In some instances (not shown), it may be preferred to use only a single frustoconical section for lower surface 40. This surface extends from a single transition point, with that single transition point being between the two transition points 51, 52 on upper surface 38.

In its unstretched configuration as shown in FIGS. 3 and 4, housing core 30 has a wall thickness of substantially 0.109 inches and outer edge 42 is approximately is 1.090 inches from outer surface 34 of core 30 so that $D_2'$ equals approximately 3.614 inches. $D_1'$ is substantially equal to 1.216 inches.

Upon assembly of arrester 10, MOV's 26 and terminals 24 are secured into a subassembly by retention means 28. To install the subassembly within housing 20, a blunt, conical shaped nose cone (not shown) is placed atop a terminal 24. The nose cone includes a base portion substantially the same diameter as terminal 24 and a conical or tapered end spaced apart from the base end and extending away from array 22. The tapered end of the nose cone has a terminus that is smaller in diameter than $D_1'$. One end of unstretched housing 20 (shown in FIG. 3) is disposed about the tapered end of the nose cone and housing 20 is then drawn over array 22. As housing 20 is drawn over the array 22, it is stretched so as to accommodate array 22 and assumes the configuration shown in FIG. 2. When stretched to accommodate array 22, housing 20 shrinks in length about 8% as compared to its length before it is radially stretched to accommodate array 22. Once the housing 20 is stretched about the arrester components, the remaining steps in the assembly process of arrester 20 are performed in the following order.

The arrester module is primed with a low viscosity neutral cure silicone RTV. The primer cure is accelerated at a temperature of between 100 and 200° C. Before the housing is applied, a lubricating film of neutral cure RTV is applied, which bonds the housing to the arrestor module. The RTV can be cured at an accelerating temperature, although this not necessary. The remaining assembly steps are comparable to those known in the art of surge arresters.

Figure 5:
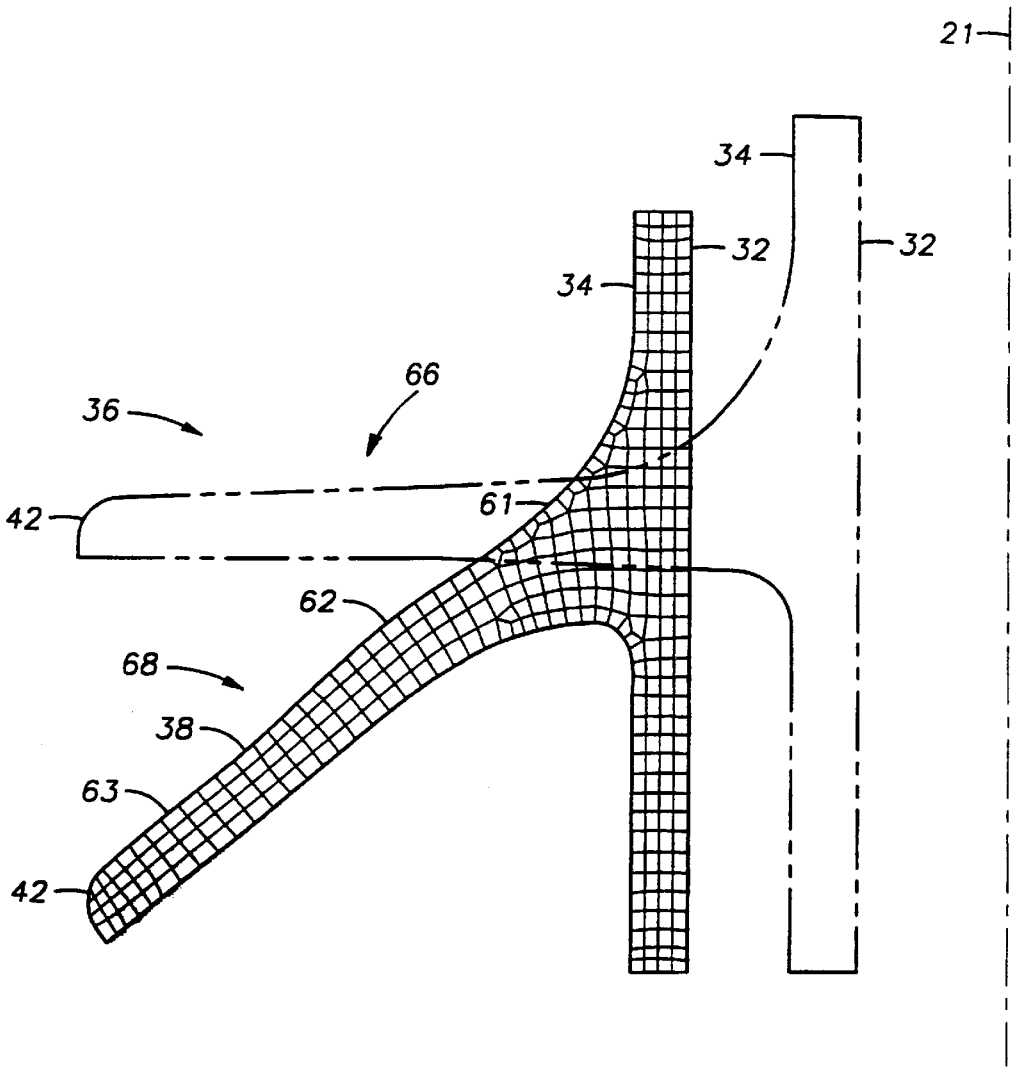
FIG. 5 is a view similar to that shown in FIG. 4 showing a cross-sectional view of a portion of the weathershed both before and after it has been stretched to accommodate and house the arrester components shown in FIG. 1.

Referring now to FIG. 5, shed 36 is shown in profile both in the as-molded, unstretched configuration, referred to generally by reference numeral 66, and its post-stretched configuration 68. As previously noted, the ends 42 of shed 36 remains in substantially the same radial position with reference to housing axis 21 even though the inner and outer surfaces 32, 34 of core 30 are moved radially outward substantial distances. In the stretched configuration 68, upper surface 38 generally comprises three interconnected curved surfaces 61–63, curved surface 61 and 63 being generally concave while curved surface 62, which is intermediate between surfaces 61 and 63, is generally convex. The stretched configuration is a function of relative volumes of the unstretched upper and lower portions of each shed.

The present shedded elastomeric housing provides superior performance and costs less to manufacture than many previously known housings. Cost savings are realized because the perpendicular sheds of the present invention are much easier to demold during the manufacturing process. The ease of demolding allows the sheds on the present housing to be significantly thinner, requiring the use of less material. Quality is also improved both in the housing itself and its performance. Housing quality is improved because the simpler molded shape results in a lower defect rate in molded parts.

Performance is improved because the elastomeric housing can conform to irregularities in the array, particularly if it is used in conjuction with a silane surface treatment and/or a silicone RTV material. The silane surface treatment and/or silicone RTV material acts to bond the present housing to the array so as to prevent the ingress of moisture therebetween and also functions as a lubricant and void-filling compound during the insertion of the arrester module. The present method is advantageous over conventional methods of molding a housing over an array, as this molding process requires lower viscosity, less desirable silicones compounds so as to avoid shifting of the array due to high forces that are imposed during molding. Other suitable bonding agents include silane primers, silicone grease, silicone spray, and similar substances, but it is preferred to use substances that provide a bonded interface.

Ability to perform under operating conditions is affected by the quality of the interface between the housing and the array. A good measure of performance can be made using MultiStress techniques commonly applied on polymeric insulators and arresters, such as the Italian National utility (ENEL) procedure DY1009 or the IBC procedure EC1109 (1992). Adequate performance per the ENEL procedure has been achieved due solely to the pressure exerted on the interface due to the level of stretch, provided that the interface is substantially air free or that air pockets are large enough and controllable positioned so as to avoid creating unacceptable high localized dielectric stresses. The degree of flexibility of the housing depends on the material selected and on the anticipated voltage level. Adequate performance has been demonstrated on an arrestor product having an air-filled open-weave fiberglass cage similar to that described in U.S. Pat. No. 5,043,838. Good performance has also been demonstrated on arrester products using a silicone grease substantially air displacing interface on arresters constructed as described in U.S. Pat. No. 4,656,555 and the copending application mentioned above. The best performance has been achieved using a substantially bonded interface and the arrester module construction as described in our copending application. Adequate bonding has been achieved using a neutral cure RTV silicone compound at the interface between the housing and the array. As discussed above, this material also lubricates the housing during placement of the housing over the array. Further improvements have been noted when the resin coated modules have been primed with either a silane-based primer or a spray-on, cured RTV coating similar to those commonly used to coat high voltage ceramic insulators.

While preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. An elastomeric housing for electrical apparatus, comprising a deformable shedded sleeve having a central axis and comprising a tubular core portion with a central bore and a plurality of axially-spaced sheds extending from said core;

wherein:

said core is unstretched when formed and is stretched when an electrical device is inserted in the central bore to form an electrical apparatus, and said sleeve has a first configuration when said core is unstretched and a second configuration when said core is stretched;

said sheds extend from said core at a first angle relative to said axis when said sleeve is in said first configuration and extend from said core at a second angle relative to said axis when said sleeve is in said second configuration;

said sheds extend substantially perpendicularly from said core when said sleeve is in said first configuration and said sleeve assumes said second configuration when said core is stretched radially outwardly; and when said sleeve is in said first configuration, said sheds include an upper surface that joins said core in a first shoulder having a radius of curvature $R_1$ and a lower surface that joins said core in a second shoulder having a radius of curvature $R_2$, with $R_1$ being grater than $R_2$.

2. The elastomeric housing according to claim 1 wherein when said sleeve is in said second configuration, said sheds extend downwardly from said core at an angle within the range of approximately 10 to 45° as measured from a plane that is perpendicular to said axis.

3. The housing according to claim 2 wherein $R_1$ is at least twice as large as $R_2$ when said sleeve is in said first configuration.

4. The housing according to claim 2 wherein said sleeve has substantially the same overall diameter in said first and said second configurations.

5. The housing according to claim 4 wherein in said first configuration, said central bore has a diameter equal to $D_1$ and wherein in said second configuration said bore has a diameter equal to $D_2$, where $D_2$ is greater than $D_1$.

6. The housing according to claim 2 wherein said sheds include a first end disposed at a predetermined radial position relative to said axis and a second end attached to said core portion, and wherein when said sleeve is in said second configuration, said sheds include a generally frustoconical upper surface and a convex portion on said upper surface between said first and said second ends.

7. The housing according to claim 1 wherein said sheds include an end disposed at predetermined radial and axial positions when said sleeve is in said first configuration and wherein when said shed is deformed to said second configuration, said shed ends are disposed in axial direction away from said first predetermined position but remain at said first predetermined radial position.

8. A housing for electrical apparatus, comprising:

an elastomeric sleeve having a tubular core portion with a central axis and a central bore and having a plurality of sheds radiating from said core portion;

wherein said sheds have ends disposed at a predetermined radial distance from said axis;

wherein said sheds include an upper surface comprising a first frustoconical surface segment joined to said core portion in an upper shoulder having a radius of curvature $R_1$ and a second frustoconical surface segment joined to said first frustoconical surface segment at a first transition point $T_1$; and wherein said sheds include a lower surface comprising a third frustoconical surface segment joined to said core portion in a lower shoulder having a radius of curvature $R_2$ that is less than $R_1$ and fourth frustoconical surface segment joined to said third frustoconical surface segment at a second transition point $T_2$ that is radially closer to said axis than $T_1$.

9. The housing according to claim 8 wherein said first frustoconical surface segment tapers downwardly from said upper shoulder to said first transition point at an angle $\alpha_1$ and wherein said second frustoconical surface segment tapers downwardly from said first transition point toward said end of said shed at an angle $\alpha_2$, wherein $\alpha_2$ is less than $\alpha_1$.

10. The housing according to claim 9 wherein said third frustoconical surface segment tapers upwardly from said lower shoulder to said second transition point at an angle $\alpha_3$ and wherein said fourth frustoconical surface segment tapers upwardly from said second transition point to said end of said shed at an angle $\alpha_4$ that is less than $\alpha_3$.

11. The housing according to claim 10 wherein $\alpha_1$ is at least twice as great as $\alpha_2$.

12. The housing according to claim 10 wherein $\alpha_1$ is at least four times as great as $\alpha_2$.

13. The housing according to claim 10 wherein $\alpha_3$ is substantially equal to $\alpha_4$.

14. The housing according to claim 10 wherein $\alpha_2$ is at least twice as large as $\alpha_4$.

15. The housing according to claim 10 wherein first frustoconical surface segment intersects said upper shoulder at a third transition point and said third frustoconical surface segment intersects said lower shoulder at a fourth transition point, and wherein said fourth transition point is radially closer to said axis than said third transition point.

16. The housing according to claim 10 wherein $R_1$ is at least twice as large as $R_2$.

17. The housing according to claim 8 wherein said sleeve is deformable from a first configuration when said core is unstretched to a second configuration when said core is stretched radially outwardly, said ends of said sheds being lower when said sleeve is in said second configuration compared to first configuration.

18. The housing according to claim 17 wherein when said sleeve is in said second configuration, said ends of said sheds remain at said predetermined radial distance from said axis.

19. An elastomeric housing for electrical apparatus, comprising:

a deformable shedded sleeve having a central axis and comprising a tubular core with a central bore having an inside diameter and a plurality of axially-spaced sheds having upper and lower surfaces and radiating from said core in a first configuration when said core is unstretched, wherein said sheds extend substantially perpendicularly from said axis when said sleeve is in said first configuration;

said sleeve being deformable from said first configuration when said core is unstretched to a second configuration when an electrical device is inserted in the central bore to form an electrical apparatus in which said sheds assume a downwardly extending position and said upper surface of said shed is generally frustoconical; and when said sleeve is in said first configuration, said sheds including an upper surface that joins said core in a first shoulder having a radius of curvature $R_1$ and a lower surface that joins said core in a second shoulder having a radius of curvature $R_2$, with $R_1$ greater than $R_2$.

20. The elastomeric housing according to claim 19 wherein when said sleeve is in said first configuration, each of said upper and lower surfaces includes at least one frustoconical portion.

21. The elastomeric housing according to claim 20 wherein when said sleeve is in said first configuration, said first frustoconical portion intersects a plane perpendicular to said axis at an angle of approximately 2.5°.

22. The elastomeric housing according to claim 20 wherein each of said upper and lower surfaces includes two concentric frustoconical portions.

23. The elastomeric housing according to claim 22 wherein when said sleeve is in its first configuration, said second frustoconical portion intersects a plane perpendicular to said axis at an angle of less than approximately 2.5°.

24. The elastomeric housing according to claim 23 wherein $R_1$ is at least twice as large as $R_2$.

25. The elastomeric housing according to claim 24 wherein each of said upper and lower surfaces includes a first frustoconical portion, said upper first frustoconical portion intersecting said first shoulder at a first upper transition point and said lower first frustoconical portion intersecting said second shoulder at a first lower transition point, said first upper transition point being at a greater radial distance from said axis than said first lower transition point.

26. The elastomeric housing according to claim 25 wherein each of said upper and lower surfaces further includes a second frustoconical portion, said upper second frustoconical portion intersecting said upper first frustoconical portion at a second upper transition point and said lower second frustoconical portion intersecting said lower first frustoconical portion at a second lower transition point, said second upper transition point being at a greater radial distance from said axis than said second lower transition point.

27. The elastomeric housing according to claim 19 wherein each shed has an upper surface and a lower surface and wherein when said sleeve is in said second configuration, said upper surface includes first and second circumferentially concave portions and a first circumferentially convex portion therebetween.

28. The elastomeric housing according to claim 19 wherein said sheds comprise radially extending members having outer edges, said radially extending members decreasing in thickness toward their outer edges.

29. The elastomeric housing according to claim 28 wherein in both said first and second configurations, said outer edges of said sheds remain at substantially the same radial position relative to said axis.

* * * * *